US011525220B2

(12) United States Patent
Hanaya et al.

(10) Patent No.: US 11,525,220 B2
(45) **Date of Patent: *Dec. 13, 2022**

(54) PROCESS FOR PRODUCING FIBROUS BOARD

(71) Applicant: UNITIKA LTD., Amagasaki (JP)

(72) Inventors: Kazutoshi Hanaya, Osaka (JP); Masaya Akao, Tokyo (JP); Yusuke Nagatsuka, Okazaki (JP)

(73) Assignee: UNITIKA LTD., Hyogo (JP)

( * ) Notice: Subject to any disclaimer, the term of this patent is extended or adjusted under 35 U.S.C. 154(b) by 539 days.

This patent is subject to a terminal disclaimer.

(21) Appl. No.: 16/605,385

(22) PCT Filed: Apr. 18, 2018

(86) PCT No.: PCT/JP2018/016013

§ 371 (c)(1),
(2) Date: Oct. 15, 2019

(87) PCT Pub. No.: WO2018/194096

PCT Pub. Date: Oct. 25, 2018

(65) Prior Publication Data

US 2020/0123712 A1 Apr. 23, 2020

(30) Foreign Application Priority Data

Apr. 19, 2017 (JP) ..... JP2017-082599

(51) Int. Cl.

| | |
|---|---|
| ***D21J 1/04*** | (2006.01) |
| ***D21H 13/24*** | (2006.01) |
| ***D21H 15/10*** | (2006.01) |
| ***D04H 1/48*** | (2012.01) |
| ***D01F 8/14*** | (2006.01) |
| ***D04H 1/541*** | (2012.01) |

(52) U.S. Cl.

CPC ..... *D21J 1/04* (2013.01); *D01F 8/14* (2013.01); *D04H 1/48* (2013.01); *D04H 1/5412* (2020.05); *D21H 13/24* (2013.01); *D21H 15/10* (2013.01)

(58) Field of Classification Search

CPC ..... D21J 1/04; D21H 13/24; D21H 15/10; D04H 1/48; D04H 1/541; D01F 8/14

See application file for complete search history.

(56) References Cited

U.S. PATENT DOCUMENTS

| | | | | |
|---|---|---|---|---|
| 3,437,063 | A | 4/1969 | Battersby | |
| 5,591,289 | A | 1/1997 | Souders et al. | |
| 11,186,931 | B2 * | 11/2021 | Hanaya | D04H 1/43835 |
| 2003/0134115 | A1 | 7/2003 | Goda et al. | |
| 2004/0248490 | A1 | 12/2004 | Hyuga et al. | |
| 2008/0299367 | A1 | 12/2008 | Yamamoto | |
| 2010/0133173 | A1 | 6/2010 | Inagaki | |
| 2014/0070562 | A1 | 3/2014 | Inagaki | |
| 2014/0154943 | A1 * | 6/2014 | Choi | D01F 6/62 28/165 |
| 2015/0133019 | A1 | 5/2015 | Mori et al. | |
| 2018/0171129 | A1 * | 6/2018 | Gong | B32B 25/02 |
| 2020/0063304 | A1 | 2/2020 | Hanaya et al. | |

FOREIGN PATENT DOCUMENTS

| | | | |
|---|---|---|---|
| CN | 1460136 | | 12/2003 |
| CN | 101445972 | | 6/2009 |
| CN | 101680185 | | 3/2010 |
| CN | 101713109 | | 5/2010 |
| CN | 104379826 | | 2/2015 |
| CN | 105063797 | | 11/2015 |
| CN | 105437699 | | 3/2016 |
| JP | S59-15530 | | 1/1984 |
| JP | 63270812 | A * | 11/1988 |
| JP | 08-188947 | | 7/1996 |
| JP | H09-119056 | | 5/1997 |
| JP | H10-025652 | | 1/1998 |
| JP | H10-298271 | | 11/1998 |
| JP | H10-298828 | | 11/1998 |
| JP | 2000-095227 | A | 4/2000 |

(Continued)

OTHER PUBLICATIONS

English translation of Japanese Patent Application Publication No. 63-270812 to Ohashi et al. obtained from the European Patent Office website (Year: 1988).*

International Preliminary Report on Patentability issued for PCT/JP2018/016013, Oct. 22, 2019, 6 pages.

Office Action issued for the corresponding Chinese Patent Application No. 201880025367.5, dated Jun. 25, 2021, 16 pages including machine translation.

Office Action issue for the corresponding Chinese Patent Application No. 201880025367.5, dated Feb. 15, 2022, 16 pages including machine translation.

International Search Report of PCT/JP2018/016013, dated Sep. 18, 2018, 5 pages including English translation.

Office Action issued in Japanese Patent Application No. 2016-241154, dated Sep. 27, 2017, 5 pages, with English translation.

International Search Report of International Application No. PCT/JP2017/044478, dated Feb. 27, 2018, 6 pages, with English translation.

(Continued)

*Primary Examiner* — Jeremy R Pierce

(74) *Attorney, Agent, or Firm* — Hamre, Schumann, Mueller & Larson, P.C.

(57) ABSTRACT

An object of the present invention is to provide a process for producing fiberous board with which fiberous board exhibiting high bending strength and high stiffness at a wide range of heating temperatures and a wide range of compressing and heating times. In the present invention, fiberous board having an initial flexural modulus of at least 300 MPa in three point bending test is obtained by forming a web by correcting sheath-core composite fibers of which a core component is formed from a copolymer of ethylene glycol and terephthalic acid and the sheath component is formed from ethylene glycol, adipic acid, terephthalic acid, isophthalic acid; and/or diethylene glycol. The web is then compressed in a direction of thickness and heated, so that the sheath component softens and melts and the sheath-core composite fibers are melt bonded together and molded into a flat plate shape.

11 Claims, No Drawings

(56) References Cited

FOREIGN PATENT DOCUMENTS

| | | | |
|---|---|---|---|
| JP | 2001-054709 | | 2/2001 |
| JP | 2001-172828 | | 6/2001 |
| JP | 2003-166159 | | 6/2003 |
| JP | 2003-171826 | | 6/2003 |
| JP | 2003-325411 | | 11/2003 |
| JP | 2004-107860 | | 4/2004 |
| JP | 2004-107860 | A | 4/2004 |
| JP | 2004-359066 | A | 12/2004 |
| JP | 2005-042289 | A | 2/2005 |
| JP | 3725488 | | 12/2005 |
| JP | 2016-211081 | | 12/2016 |
| JP | 2018-009256 | | 1/2018 |
| JP | 6313841 | B1 | 4/2018 |
| KR | 10-2014-0028960 | | 3/2014 |
| WO | 2006/092835 | | 9/2006 |
| WO | 2012/164977 | A1 | 12/2012 |
| WO | 2018/110524 | | 6/2018 |

OTHER PUBLICATIONS

International Preliminary Report on Patentability of PCT/JP2017/044478, dated Jun. 18, 2019, 11 pages, with English translation.

Office Action including a Search Report datted Jan. 2, 2020 in Chinese patent application No. 201780076527.4, 13 pages with English translation of the Office Action.

Office Action including a Search Report dated Jul. 9, 2020 for Chinese patent application No. 201780076527.4, 16 pages including machine translation.

Office Action issued for Chinese Patent Application No. 201780076527.4, dated Oct. 28, 2020, 13 pages including machine translation.

International Search Report of PCT/JP2018/015104, dated Jun. 5, 2018, 5 pages including English translation.

International Preliminary Report on Patentability issued for PCT/JP2018/015104, dated Oct. 15, 2019, 7 pages.

Office Action issued for Chinese Patent Application No. 201880024253.9, Jun. 22, 2021, 22 pages including machine translation.

* cited by examiner

PROCESS FOR PRODUCING FIBROUS BOARD

TECHNICAL FIELD

The present invention is related to a process for producing a fibrous board having excellent stiffness, particularly a process for producing a fibrous board having excellent stiffness and excellent bending strength without closely controlling production conditions.

BACKGROUND ART

Hitherto, it has known to the art that sheath-core composite fiber composed of a core component formed from high melting point polymer and a sheath component formed from low melting point polymer is employed and only the sheath components are melted to bond the sheath-core composite fibers with each other, thus obtaining a fibrous board having relatively high stiffness (Patent Literature 1). In Examples of the Patent Literature 1, it is disclosed that a sheath-core composite fiber of which the core component is formed from polyethylene terephthalate and the sheath component is formed from polyethylene is employed and put into a melt extruder to pour it out from a die to form a plate-like fibrous plastic board.

CITATION LIST

Patent Literature

PTL 1

JP 3725488 B

SUMMARY OF INVENTION

Technical Problem

The present invention is directed to an improvement of the invention of the Patent Literature 1, wherein specific polymers are employed as the core component and the sheath component so as to provide a fibrous board having excellent stiffness and excellent bending strength, even using a wide range of heating temperatures and a wide range of heating and compressing times.

Solution to Problem

Accordingly, the present invention is to provide a process for producing a fibrous board having an initial flexural modulus of not less than 300 MPa in a three point bending test, wherein sheath-core composite fibers, of which the core component is formed from a copolymer of ethylene glycol and terephthalic acid and the sheath component is formed from ethylene glycol, adipic acid, terephthalic acid and isophthalic acid; and/or diethylene glycol, are collected to form a web, and then the web is compressed in a direction of thickness direction and heated to soften or melt the sheath components so as to bond the sheath-core composite fibers with each other, followed by shaping it into a plate to form a fibrous board.

In the present invention, a fibrous web is produced from a specific sheath-core composite fiber which constitutes a structured fiber. In this context, the sheath-core composite fiber is consisted of a core component formed from a copolymer of ethylene glycol and terephthalic acid and a sheath component formed from ethylene glycol, adipic acid, telephthalic acid and isophtalic acid; and/or diethyelene glycol. The copolymer for the core component is a polyester of ethylene glycol as diol component and terephthalic acid as dicarboxylic acid. The dicarboxylic acid can contain a very small amount of another dicarboxylic acid, such as isophthalic acid and the like. The copolymer constituting the core component preferably has a melting point of about 260° C. and a glass transition temperature of about 70 to 80° C. The copolymer constituting the sheath component is a copolymerized polyester obtained by a dehydration condensation of ethylene glycol and if any diethylene glycol as diol component and adipic acid, terephthalic acid and if any isophthalic acid as dicarboxylic acid component. Either diethylene glycol or isophthalic acid should be employed and preferably both are employed. Mixing diethylene glycol and/or isophthalic acid can enhance heat formability of the resulting fiber. When diethylene glycol is mixed to the diol component, ethylene glycol: diethylene glycol can be within a range of 10:0.05 to 0.5 (molar ratio). A mixing ratio of adipic acid and terephthalic acid as dicarboxylic acid component can be any ratio, but adipic acid:terephthalic acid can be within a range of 1:1 to 10 (molar ratio). When isophthalic acid is added in the dicarboxylic acid component, it is general that isophthalic acid:adipic acid:terephthalic acid can be within a range of 0.04 to 0.6:1:1 to 10 (molar ratio). Melting point and glass transition temperature of the copolymer of the sheath component can be any, but preferred is about 200° C. for melting point and 40 to 50° C. for glass transition temperature in view of fusion properties of the sheath components and shaping ability by heat and pressure.

A weight ratio of the core component and the sheath component can be within a range of core component:sheath component=0.3 to 5:1 (weight ratio). If the core component is lower than the range, shape retention after heat shaping would be lower. If it is higher than the range, the sheath components would have difficult in fusion properties and surface fluffing would be heavy. The core component and the sheath component can be disposed concentrically or eccentrically, but concentric disposition would be preferred because contraction would arise when heating if it is disposed eccentrically.

The sheath-core composite fiber can be obtained by art known method wherein a high melting point polyester for the core component and a low melting point copolymerized polyester for the sheath component are put in a spinning apparatus having composite spinning holes to melt spin. The sheath-core composite fiber can be either continuous filament or staple fiber, but the continuous filaments are preferred for obtaining high stiffness filamentous board. In order to obtain filamentous web using the sheath-core composite continuous filaments, so-called spun bond method is generally employed. The sheath-core composite continuous filaments obtained by melt spinning are directly accumulated in the form of a sheet to obtain filamentous web. In the case of obtaining a fibrous web from the sheath-core composite staple fibers, the staple fibers are passed through a card machine to open fibers and accumulated in the form of sheet. It is preferred that an amount of web can be at least 150 g/m$^2$, more preferably at least 300 g/m$^2$. If the web is lighter than the lower limit, its thickness becomes thin and the fibrous board has poor stiffness. In addition, there is no upper limit regarding the weight of the web, but the upper limit can generally be 2,000 g/m$^2$. If the weight is more than the upper limit, the resulting fibrous board is heavy and is difficult to handle.

The web can be compressed in a direction of thickness as it is and simultaneously heated, or it can be temporary bonded between the composite fibers and then compressed in a direction of thickness and heated simultaneously. In addition, the web can be needle punched and then compressed in a direction of thickness and heated simultaneously. When needle punching, the web can be needle punched when the sheath-core composite fibers are not temporary bonded with each other or when they are temporary bonded with each other. In the case of the former method, it is preferred that, since the fibers are not temporary bonded with each other, needle punching does not make damages on the fibers and does not cause reduction of strength by fiber breakage. In addition, in the case of the latter method, since the fibers are temporary bonded with each other, the web can be easily treated or transported. The needle punching can be conducted by any art known method and thereby the sheath-core composite fibers are three dimensionally interlaced to obtain a closely interlaced nonwoven fabric in which the fibers are aligned in the direction of thickness. In the case where the sheath-core composite fibers are temporary bonded with each other, the needle punching would break some of the bonding and would let the fibers three-dimensional interlaced. The punching density would be a level of about 10 to 200 punches/$cm^2$.

A method for simultaneously compressing in a direction of thickness and heating the web can include any methods art-known. Representative examples are the following two methods: As the first method, the web is preliminary heated and then put between metal plates with normal temperature to compress in a direction of thickness. In the other method, the web with normal temperature is put between metal plates which have been heated to compress in a direction of thickness. Heating conditions and compressing conditions in the thickness direction are such that the sheath component of the sheath-core composite fiber is softened or melted and the composite fibers are melt bonded with each other. Concrete examples of the conditions are a heating temperature of 100° C. to 200° C. and a compression condition of 1 to 500 kg/$cm^2$ in surface pressure. A heating and compressing time can be about 10 to 150 seconds. With the conditions, the web is heated and compressed in a direction of thickness and the sheath components of the sheath-core composite fibers are soften and melted to melt bond the sheath-core composite fibers with each other, thus molding it into a plate like shape. In this context, by the term "plate like shape" is meant that web has a plate shape, but its whole portions are not completely plate and it can be plate shape in most portions, thus the other portions being curving or bending.

In the fibrous board obtained by the process of the present invention, the sheath components of the sheath-core composite fibers are melt bonded with each other and they are strongly bonded. In the case where the sheath components are sufficiently melted, the sheath components are present as a matrix and the core components are present in the form of fiber in the matrix, thus forming a fibrous board. In the case where the sheath components are merely softened or partially melted, the sheath components do not form a matrix and the fibrous board has many voids in the sheath-core composite fibers. In any cases, the fibrous board obtained by the process of the present invention has an initial flexural modulus of not less than 300 MPa in a three point bending test, which is highly stiffened. In this context, the initial flexural modulus is calculated based on an initial slope of strain-bending load in the three point bending test.

The fibrous board obtained by the process of the present invention can be employed for many applications. Concrete examples of the applications include a sound absorbing material, an interior part and the like. It can also be employed as a substitute of a conventional plastic plate.

Advantageous Effects of Invention

In the process of the present invention, since the sheath component of the sheath-core composite fiber is formed from a specific polyester copolymer, the resulting fibrous board with high stiffness is obtained even with a wide range of temperature ranges as well as a wide range of pressuring and heating times. Accordingly, it is good technical effect that a fibrous board with high stiffness and high bending strength can be obtained without severely controlling or using heating and compressing conditions.

EXAMPLE 1

A copolymer of ethylene glycol and terephthalic acid (a melting point of 260° C.) was prepared as a core component. A copolymer of ethylene glycol, diethylene glycol, adipic acid, terephthalic acid and isophthalic acid (a melting point of 200° C.) was prepared as a sheath component. The diol components contained 99 mole % of ethylene glycol and 1 mole % of diethylene glycol, and the dicarboxylic acids contained 19 mole % of adipic acid, 78 mole % of terephthalic acid and 3 mole % of isophthalic acid. Both of the core component and sheath component were provided into a spinning apparatus having composite spinning holes and then melt spun to obtain a sheath-core composite continuous filament. The sheath-core composite continuous filament had a weight ratio of core component:sheath component=7:3. The filaments were introduced into an air sucker located under the spinning apparatus and rapidly sucked and thinned, followed by open filaments by an art-known opening devise to collect and to accumulate on a moving screen conveyer to obtains filamentous web. The filamentous web was conveyed to a needle punching machine and needle punched at a punch density of 90 punches/$cm^2$ and a needle depth of 10 mm, to obtain a needle punched nonwoven fabric having a weight of 900 g/$m^2$.

The resulting needle punched nonwoven fabric was put between a pair of metal plates which had been heated at 200° C. and compressed for 60 seconds therebetween in which a spacer having 3 mm was inserted between the two metal plates. The needle punched nonwoven fabric was taken out from the pair of metal plates and left at room temperature for cooling to obtain a fibous board.

EXAMPLE 2

A fibous board was obtained as generally described in Example 1, with the exception that a pair of metal plates heated at 180° C. was employed instead of those of 200° C.

EXAMPLE 3

A fibous board was obtained as generally described in Example 1, with the exception that a compression time was changed from 60 seconds to 15 seconds.

EXAMPLE 4

A fibous board was obtained as generally described in Example 1, with the exception that a compression time was changed from 60 seconds to 30 seconds.

EXAMPLE 5

A fibous board was obtained as generally described in Example 1, with the exception that a compression time was changed from 60 seconds to 45 seconds.

COMPARATIVE EXAMPLE 1

The copolymer obtained in Example 1 was prepared as core component. A copolymer of ethylene glycol, diethylene glycol, terephthalic acid and isophthalic acid (a melting point of 200° C.) was prepared as sheath component. In the copolymer constituting the sheath component, the diol component contained 99 mole % of ethylene glycol and 1 mole % of diethylene glycol, and the dicarboxylic acid included 80 mole % of terephthalic acid and 20 mole % of isophthalic acid. Both of the core component and sheath component were provided into a spinning apparatus having composite spinning holes and then melt spun to obtain a sheath-core composite continuous filament. The sheath-core composite continuous filament had a weight ratio of core component: sheath component=6:4. The filaments were introduced into an air sucker located under the spinning apparatus and rapidly sucked and thinned, followed by open filaments by an art-known opening devise to collect and to accumulate on a moving screen conveyer to obtains filamentous web. The filamentous web was conveyed to a needle punching machine and needle punched at a punch density of 90 punches/cm$^2$ and a needle depth of 10 mm, to obtain a needle punched nonwoven fabric having a weight of 900 g/m$^2$.

The resulting needle punched nonwoven fabric was put between a pair of metal plates which had been heated at 200° C. and compressed for 60 seconds therebetween in which a spacer having 3 mm was inserted between the two metal plates. The needle punched nonwoven fabric was taken out from the pair of metal plat and left at room temperature for cooling to obtain a fibrous board.

[Measurement of Maximum Bending Strength in Three Point Bending Test]

Test pieces having a length direction of 150 mm and a wide direction of 50 mm were obtained from the fibrous boards obtained in Examples 1 to 5 and Comparative Example 1. The test pieces had a thickness of 3 mm±0.4 mm because the spacer having 3 mm was put between the pair of metal plates, but the thickness was considered to be 3 mm with rounding down. Since, in the fibrous board the sheath-core composite filaments tend to be aligned with a mechanical direction (a direction of conveying the fibrous board), highest bending strength can be obtained when the mechanical direction is aligned with the length direction of the test piece. Accordingly, the mechanical direction of the each fibrous board was aligned with the length direction of the each test piece. The test piece was placed on fulcrum points whose distance was 100 mm and a pushing plate went down at a speed of 20 mm/min at the center of the fulcrum points to load on the test piece. A maximum load when the fibrous board was broken was measured and a maximum bending strength was calculated to show in Table 1. The calculation was conducted the following equation: MPa=[6×(maximum load N)×50 mm]/[50 mm×(3 mm)$^2$].

[Measurement of Initial Flexural Modulus (MPa)]

An initial flexural modulus was calculated from an initial slope from a strain-bending load curve obtained by the measuring the maximum bending strength in the three point bending test, and it is shown in Table 1. The calculation was conducted by the following equation:

$$\text{Initial flexural modulus MPa}=[\text{Initial slope}\times(100\ \text{mm})^3]/[4\times 50\ \text{mm}\times(3\ \text{mm})^3].$$

TABLE 1

| Example Number | Maximum bending strength (MPa) | Initial flexural modulus (MPa) |
|---|---|---|
| 1 | 9.1 | 470 |
| 2 | 9.4 | 550 |
| 3 | 8.7 | 490 |
| 4 | 11.0 | 470 |
| 5 | 7.8 | 440 |
| Comparative Example 1 | 6.8 | 230 |

When the values of maximum bending strength and initial flexural modulus of the fibrous boards obtained from Examples 1 to 5 and Comparative Example 1 are compared, the fibrous boards of Examples show excellent stiffness in bending strength and excellent flexural modulus, in comparison with the fibrous board obtained in Comparative Example 1. When the values of maximum bending strength and initial flexural modulus of the fibrous boards obtained in Examples 1 to 5 are compared, the fibrous boards having excellent maximum bending strength and excellent initial flexural modulus are obtained even if heating temperature and compressing time are changed in considerable ranges.

The invention claimed is:

1. A process for producing a fibrous board having an initial flexural modulus of not less than 300 MPa in a three point bending test, comprising:

collecting sheath-core composite fibers, of which the core component is formed from a copolymer of ethylene glycol and terephthalic acid, and the sheath component is formed from ethylene glycol, adipic acid, terephthalic acid and isophthalic acid; and optionally diethylene glycol, to form a web, and then compressing the web in a direction of thickness direction and heating to soften or melt the sheath components so as to bond the sheath-core composite fibers with each other, wherein the web is shaped into a plate to form a fibrous board, and a molar ratio of isophthalic acid:adipic acid:terephthalic acid in the sheath component is within the range of 0.004 to 0.6:1:1 to 10.

2. The process of claim 1, wherein the web is preliminarily heated and sandwiched by a pair of metal plates having normal temperature and then compressed in the direction of thickness.

3. The process of claim 1, wherein the web having normal temperature is sandwiched by a pair of heated metal plates, and then compressed in the direction of thickness.

4. The process according to claim 1, wherein the web is needle punched to have the sheath-core composite fibers three dimensionally interlaced prior to the compressing and heating.

5. The process according to claim 1, wherein the fibrous board has a maximum bending strength of not less than 7.3 MPa in a three point bending test.

6. The process according to claim 1, wherein the sheath-core composite fiber is sheath-core composite continuous filament or sheath-core composite staple fiber.

7. The process according to claim 1, wherein the web is shaped into a plate to form a fibrous board by cooling after the compressing and heating.

8. The process according to claim 1, wherein a weight ratio of core to sheath is 0.3-5:1.

9. The process according to claim 1, wherein the collected web exhibits a mass of at least 150 $g/m^2$.

10. The process according to claim 1, wherein the compressing is carried out with a surface pressure of 1-500 $kg/cm^2$ and the heating is carried out at a temperature of 100-200° C.

11. The process according to claim 1, wherein the collected fibers consist of said sheath-core composite fibers, of which the core component is formed from a copolymer of ethylene glycol and terephthalic acid, and the sheath component is formed from ethylene glycol, adipic acid, terephthalic acid and isophthalic acid; and optionally diethylene glycol.

* * * * *